US007226190B2

(12) United States Patent
Petzl et al.

(10) Patent No.: US 7,226,190 B2
(45) Date of Patent: Jun. 5, 2007

(54) PORTABLE LIGHTING DEVICE WITH LIGHT-EMITTING DIODE

(75) Inventors: Paul Petzl, Grenoble (FR); Alain Maurice, Saint Hilaire du Touvet (FR)

(73) Assignee: Zedel, Crolles (FR)

( * ) Notice: Subject to any disclaimer, the term of this patent is extended or adjusted under 35 U.S.C. 154(b) by 0 days.

(21) Appl. No.: 11/637,902

(22) Filed: Dec. 13, 2006

(65) Prior Publication Data

US 2007/0097674 A1 May 3, 2007

Related U.S. Application Data

(63) Continuation of application No. 10/532,812, filed as application No. PCT/FR2004/000199 on Jan. 28, 2004, now Pat. No. 7,192,165.

(30) Foreign Application Priority Data

Jan. 29, 2003 (FR) ..... 03 00980

(51) Int. Cl.
*F21V 17/02* (2006.01)

(52) U.S. Cl. ..... 362/319; 362/157; 362/187; 362/231; 362/282; 362/322

(58) Field of Classification Search ..... 362/157, 362/187, 231, 282, 319, 322
See application file for complete search history.

(56) References Cited

U.S. PATENT DOCUMENTS 3,705,983 A 12/1972 Yamada
6,474,837 B1 11/2002 Belliveau

FOREIGN PATENT DOCUMENTS

| | | |
|---|---|---|
| DE | 283 441 | 4/1915 |
| DE | U1 85 15 726.0 | 8/1985 |
| EP | 0 111 818 A1 | 6/1984 |
| FR | 2 745 627 A1 | 9/1997 |
| GB | 2 264 164 A | 8/1993 |
| WO | WO 01/57431 A1 | 8/2001 |

*Primary Examiner*—Stephen F Husar
*Assistant Examiner*—Meghan K. Dunwiddie
(74) *Attorney, Agent, or Firm*—Oliff & Berridge, PLC

(57) ABSTRACT

A portable lighting lamp 10 comprises an emitting module equipped with at least one light-emitting diode 11 for emitting a light beam, a fixing and connecting element 12 of said diode, and an optical focussing device 15 able to be moved in front of the diode 11 to make the visualization angle of the light beam vary. The optical focussing device 15 is advantageously constituted by one or more Fresnel lenses 16 mounted on a swivelling support 17 or a rotary knob designed to occupy either an inactive position situated outside the light emission field of the diode or an active position wherein said light beam passes through the lens so as to obtain either broad lighting with a short range or narrow lighting with a long range.

1 Claim, 11 Drawing Sheets

PORTABLE LIGHTING DEVICE WITH LIGHT-EMITTING DIODE

This is a Continuation of application Ser. No. 10/532,812 filed Apr. 26, 2005, now U.S. Pat. No. 7,192,165 which in turn is a National Stage of PCT/FR04/000199 filed Jan. 28, 2004. The disclosure of the prior applications is hereby incorporated by reference herein in its entirety.

BACKGROUND

The invention relates to a portable lighting device comprising at least one light-emitting diode for emitting a light beam, a fixing and connecting element of said diode, and means for adjusting the light beam.

A light-emitting diode LED comprises in conventional manner a semi-conducting component in conjunction with a reflector inside an enclosure made of transparent plastic material, for example epoxide resin-based. The front part of the molded enclosure forms an internal lens or magnifying glass through which the light ray produced by the light-emitting diode passes when the latter has been connected to a power supply source. The visualization angle emitted by the diode depends on the shape of the reflector and on the internal distance between the component and the lens. This visualization angle is constant for a LED type diode, for example 20°, and concentrates most of the useful light flux.

To make the intensity of the light flux emitted by a LED diode vary, it is conventional to supply it by means of an adjustable current electronic circuit, for example a DC-DC converter, or a microcontroller connected to a disposable or rechargeable battery. This adjustment of the supply current causes a variation of the lighting power, but does not act on the radiation of the useful light flux. A conventional reflector of an incandescent lamp does not enable the visualization angle of a LED diode to be varied either, as it acts in a zone where the lamp emits very little light.

The document U.S. Pat. No. 6,474,837 concerns a lighting lamp with light-emitting diodes, comprising a rotating plate in the form of a diaphragm drilled with holes and equipped with lenses placed facing the holes.

The document WO 01/57,431 describes a lighting device composed of a LED diode in front of which there is permanently arranged a lens movable in translation to modify the relative distance with respect to the diode.

SUMMARY

The object of the invention is to provide a portable lighting lamp with a LED diode enabling the angle of the lighting cone of said LED diode to be easily adjusted to adjust the concentration of the light flux.

According to the invention, this object is achieved by the fact that the adjustment means comprise at least one optical focussing device able to be moved manually by a mobile support in front of the LED diode to make the visualization angle of the light beam vary. It is thus possible to obtain either broad lighting with a short range or narrow lighting with a long range.

The optical focussing device comprises a lens or magnifying glass mounted on a bistable support arranged as a swivelling or sliding plate, or a rotary knob.

According to a preferred embodiment, the lenses of Fresnel type are integrated in a transparent support to form a monoblock part. The support is made in particular of polycarbonate, resin or any other integrated optics material.

The rotary knob is movable axially on the end-part to make the axial distance arranged between the end of the knob and a stop of the fixing element vary resulting in a continuous adjustment of the angle of the lighting cone of the beam emitted by the diode.

BRIEF DESCRIPTION OF THE DRAWINGS

Other advantages and features will become more clearly apparent from the following description of particular embodiments of the invention, given as non-restrictive examples only and represented in the accompanying drawings in which.

DETAILED DESCRIPTION OF EMBODIMENTS

Figure 1:
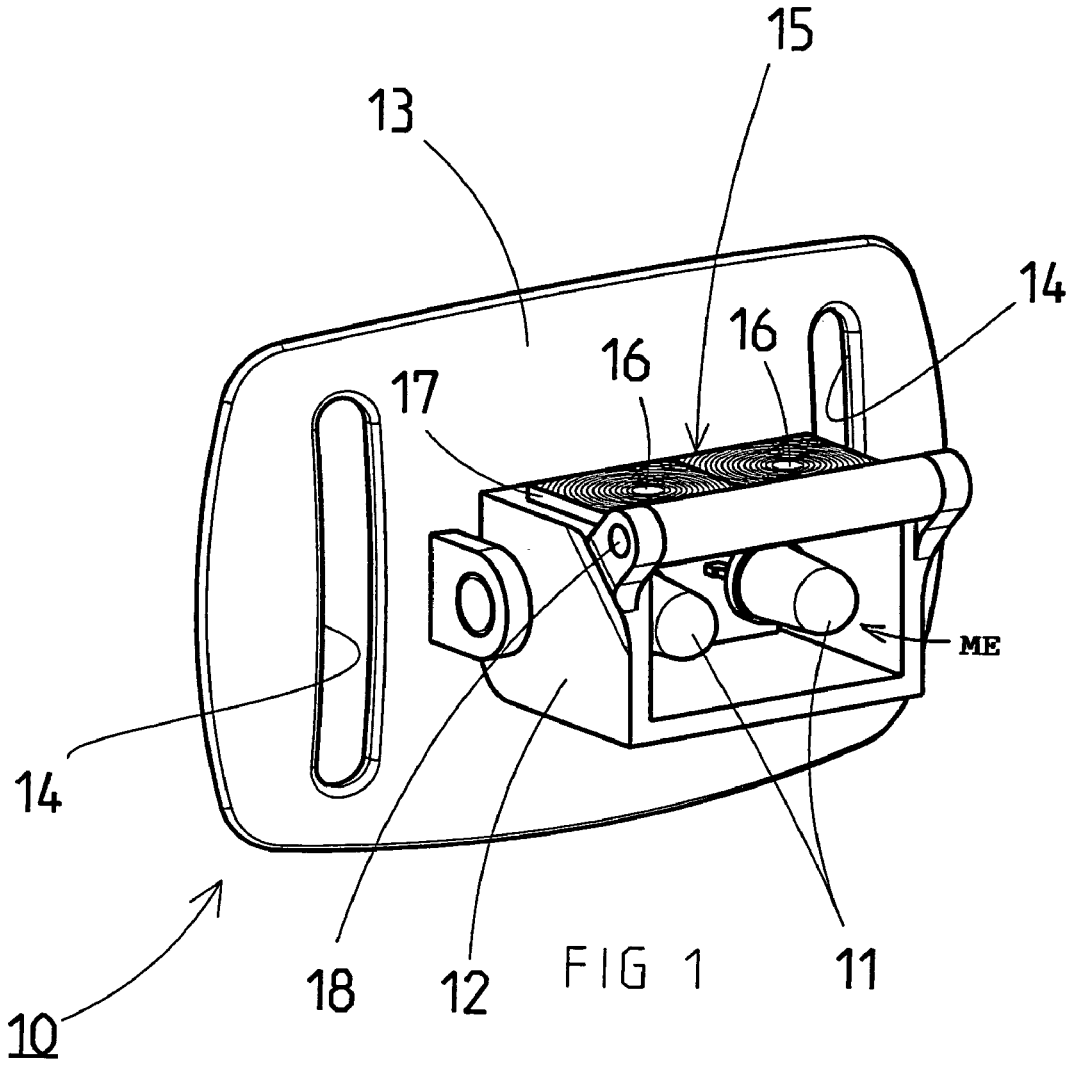
FIG. 1 is a schematic perspective view of a portable lighting lamp device according to the invention.
Figure 2:
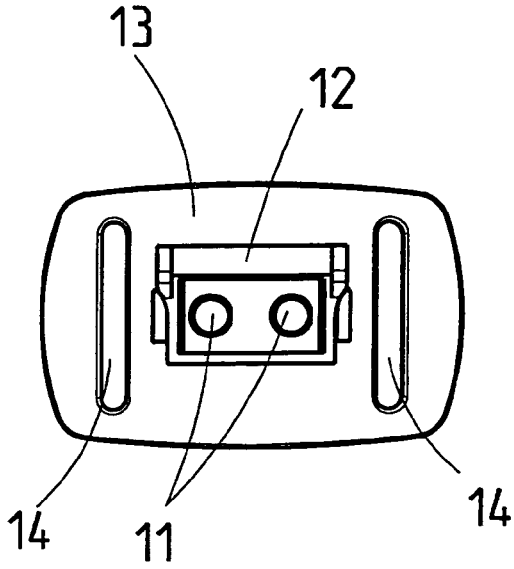
FIGS. 2 and 3 show front and side views of FIG. 1, the optical focussing device being represented in the inactive position.
Figure 3:
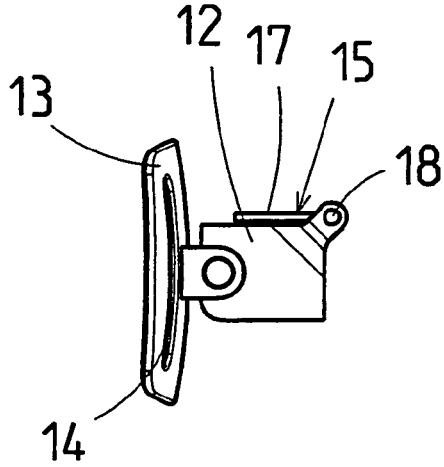
Figure 4:
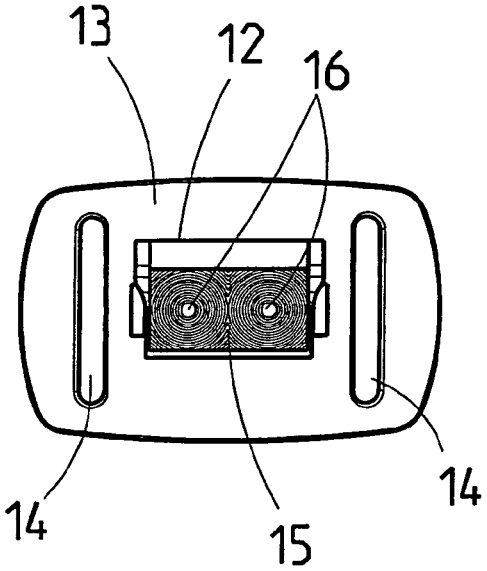
FIGS. 4 and 5 show identical views to FIGS. 2 and 3, with the optical focussing device moved by swivelling to the active position.
Figure 5:
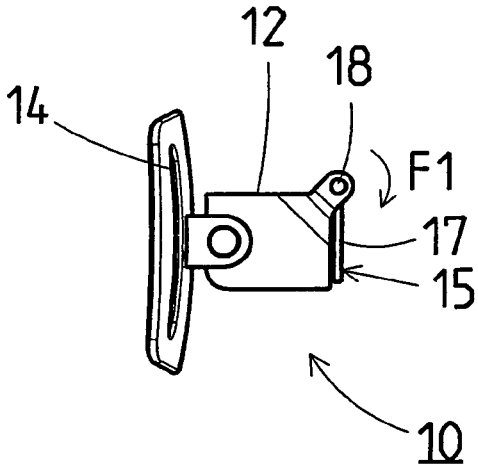
Figure 6:
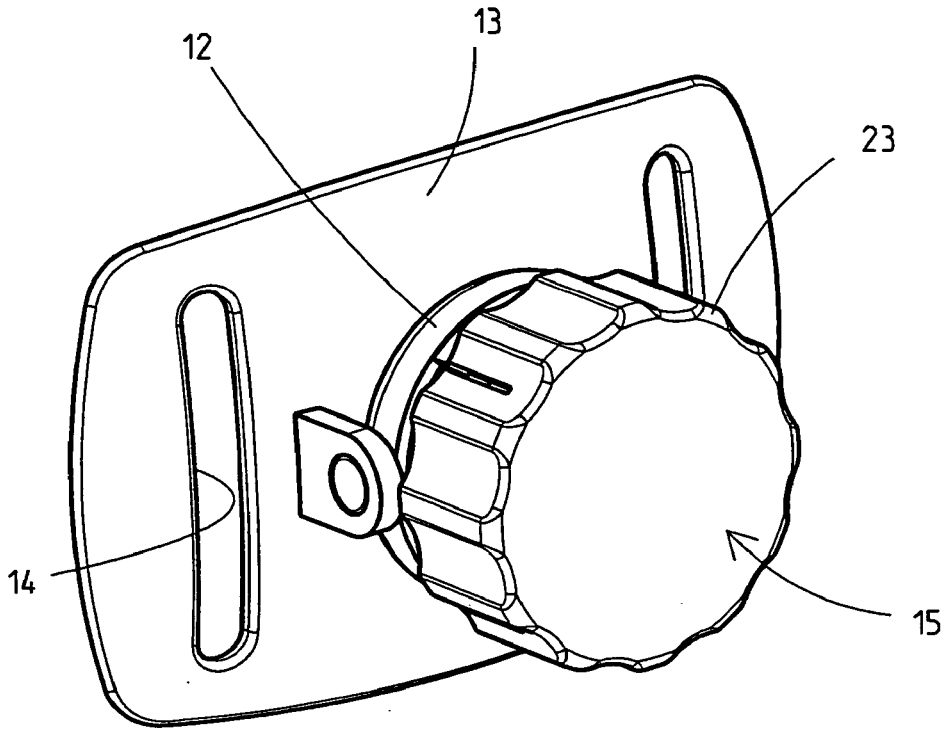
FIGS. 6 and 7 illustrate an alternative embodiment of the device of FIG. 1 respectively after fitting and removal of the optical focussing device with rotary knob.
Figure 7:
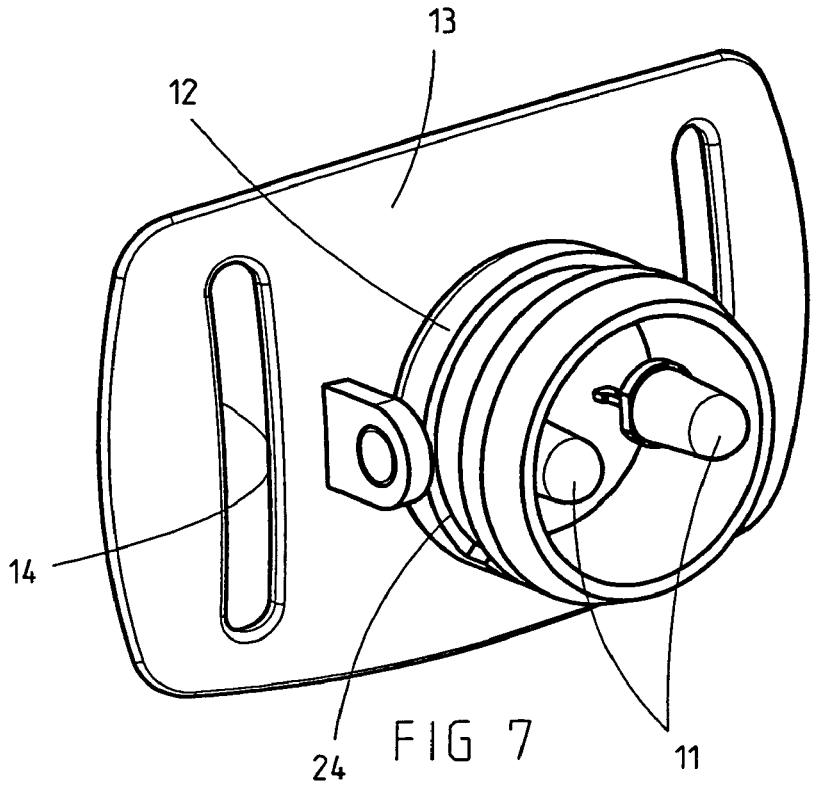
Figure 8:
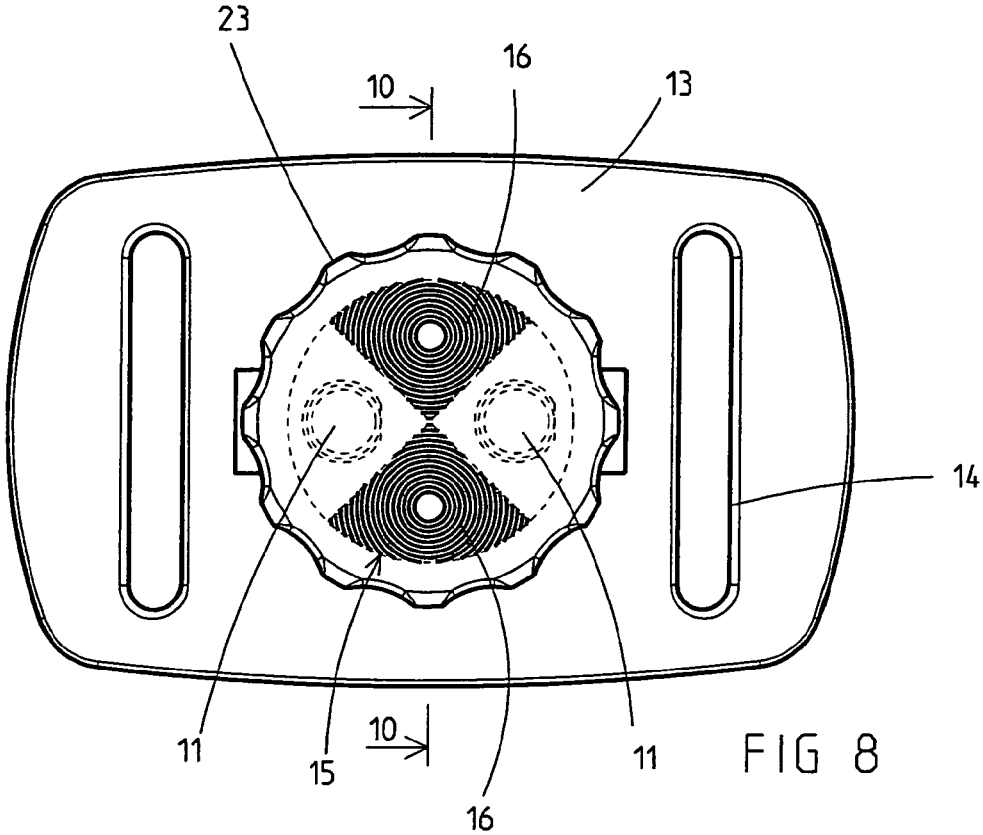
FIGS. 8 and 9 are side views of FIG. 6 respectively in the inactive position and the active position of the rotary knob.
Figure 9:
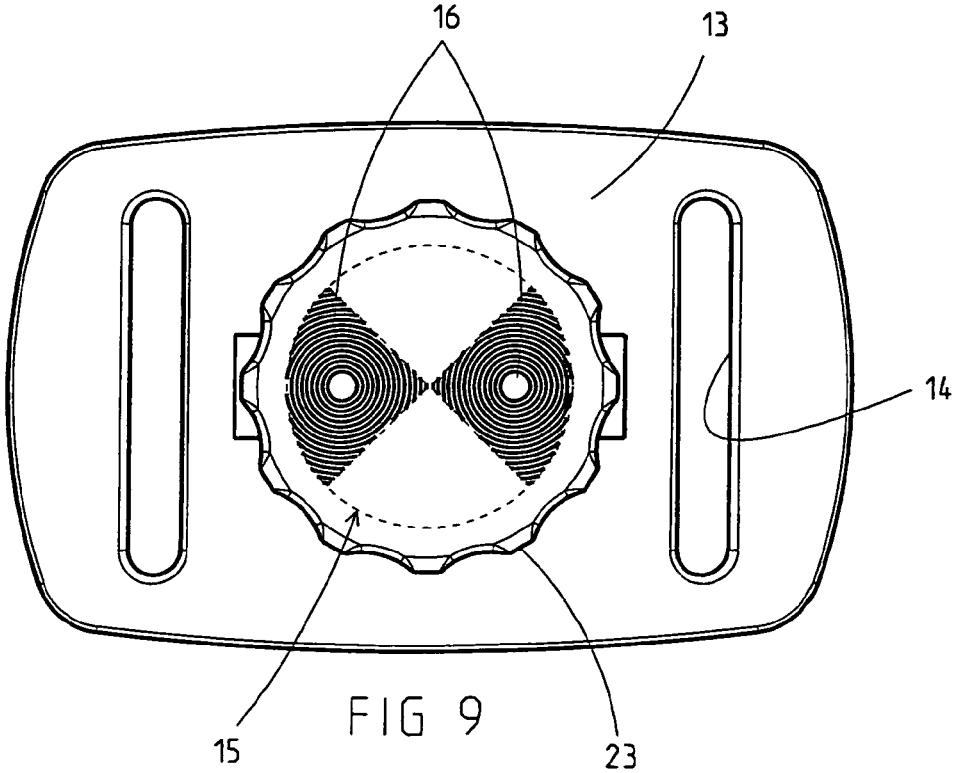

With reference to FIGS. 1 to 5, a portable lighting device 10 comprises an emitting module ME equipped with at least one light-emitting diode LED 11 for emission of a light beam, a fixing and connecting element 12 of said diode, and adjustment means for adjusting the light beam. In the example illustrated, two LED diodes are used, but it is clear that the emitting module ME can be formed by a single diode or a plurality of diodes 11 according to the nominal power required.

The fixing and connecting element 12, which is shown as a rectangular-shaped element, is secured to a base 13 equipped with a pair of slots 14 designed to receive the fixing strap (not shown) of the headlamp.

To make the angle of the lighting cone emitted by the LED diodes 11 vary, the adjustment means comprise an optical focussing device 15 able to be moved manually by the user in front of each LED diode. Two settings of the lighting cone are therefore obtained, either a broad lighting beam with a short range or a narrow lighting beam with a long range.

The optical focussing device 15 advantageously comprises two Fresnel lenses 16 fixedly secured to a mobile support movable between an inactive position situated outside the light emission field of the diodes 11 (FIGS. 1 to 3) and an active position (FIGS. 4 and 5) wherein said light beam passes through the lenses 16 undergoing a deviation of the visualization angle.

The lenses 16 are borne by a fold-down plate of the support 17 which is mounted swivelling around a horizontal spindle 18 arranged at the top part of the base 13. In the inactive position, the plate of the support 17 bears on the top edge of the element 12 letting the diodes 11 appear. In the active position, the user folds the plate of the mobile support 17 down in front of the front face of the lighting device 10 (arrow F1, FIG. 5), making the light beam emitted by the diodes 11 pass through the lenses 16. This then results in a variation of the visualization angle and of the lighting cone to obtain either broad lighting with a short range or narrow lighting with a long range.

Figure 11:
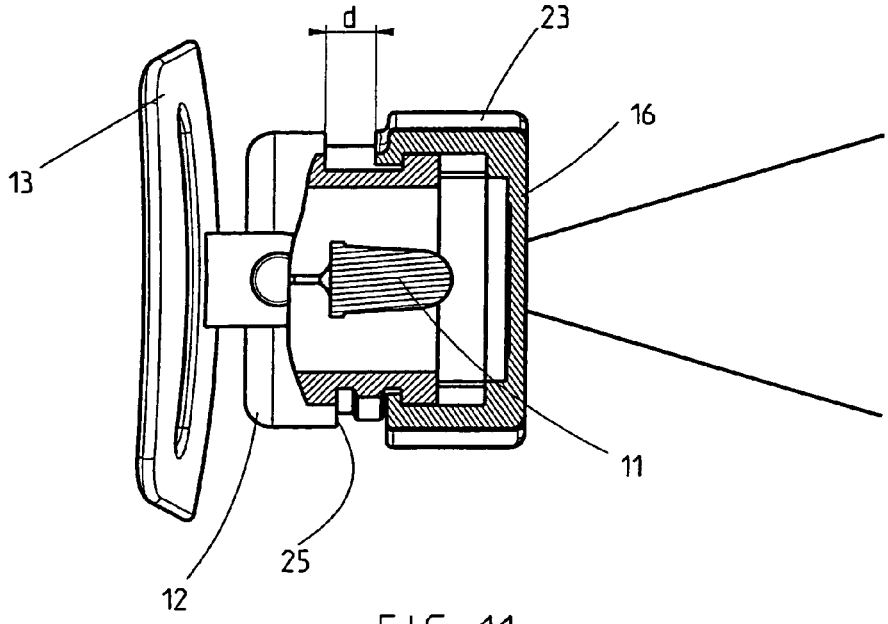
Figure 11A:
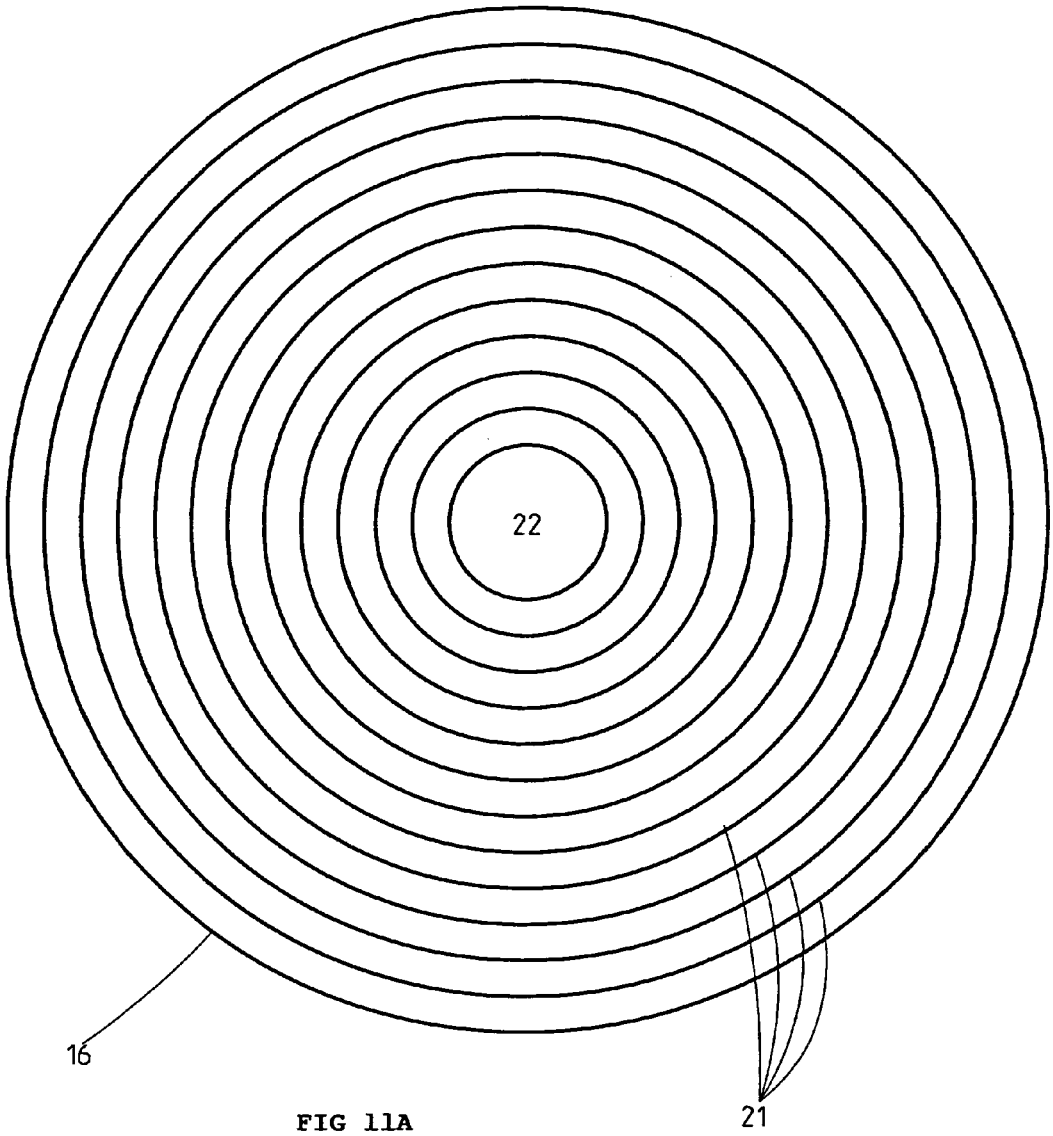
FIGS. 11A and 11B respectively represent a front view and a cross-sectional view of a Fresnel lens used in the optical focussing device.
Figure 11B:
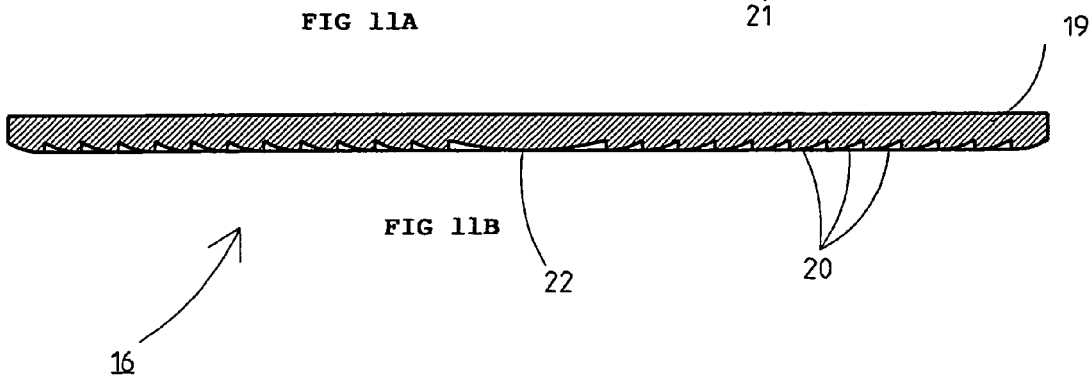

FIGS. 11A and 11B represent a Fresnel lens 16 used in the optical focussing device 15 of FIGS. 1 to 5. It comprises a flat transparent substrate 19, made of polycarbonate or resin, in which grooves 20 arranged as several concentric circular tracks 21 are etched on one of the faces. The central part 22 of the lens 16 is slightly convex and does not have any grooves 20.

It is clear that the mobile element 12 can comprise a plurality of lenses corresponding to the same number of LED diodes. The latter can be arranged in alignment, staggered, or distributed angularly at regular intervals around the periphery of the optical focussing device 15.

In the alternative embodiment of FIGS. 6 to 11, the same reference numbers will be used to designate identical or similar parts to those of FIGS. 1 to 5. The optical focussing device 15 instead of being fitted on a support 17 with a fold-down plate is fixed onto a rotary knob 23 able to rotate on an end-part 24 of a connecting element 12 serving as a support element of circular shape. The two lenses 16 are diametrically opposite, and the angular adjustment travel of the knob 23 between the inactive position (FIG. 8) and the active position (FIG. 9) corresponds to a quarter-turn in the case of two LEDs.

Figure 10:
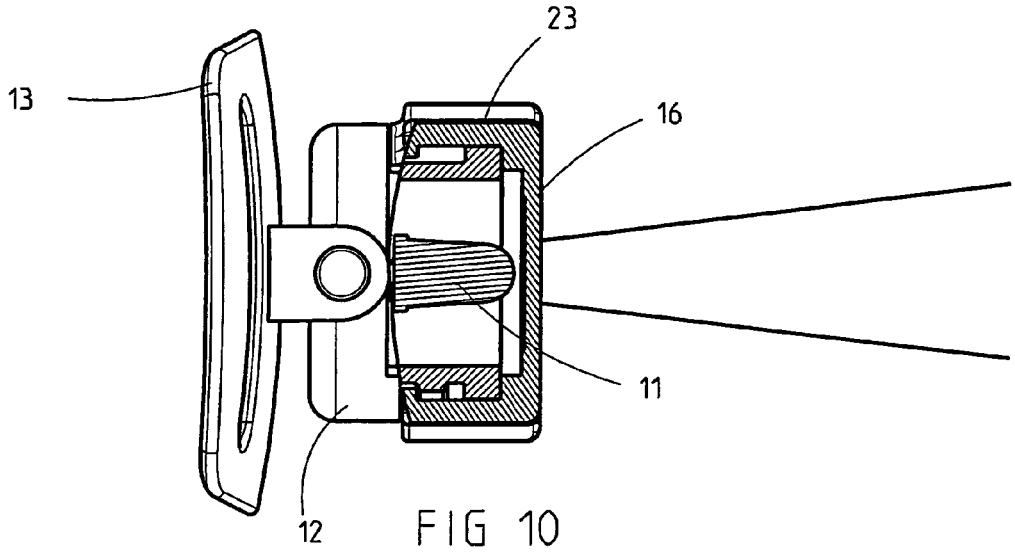
FIGS. 10 and 11 represent cross-sectional views along the line 10-10 of FIG. 8, for continuous focussing adjustment by axial movement of the rotary knob between two extreme positions.

In FIGS. 10 and 11, the distance d between the end of the knob 23 and a stop 25 of the support element 12 can be modified in the course of an axial movement of the focussing device. This results in a continuous adjustment of the angle of the lighting cone of the light beam following the relative movement of the lens 16 with respect to the diode 11.

Figure 12:
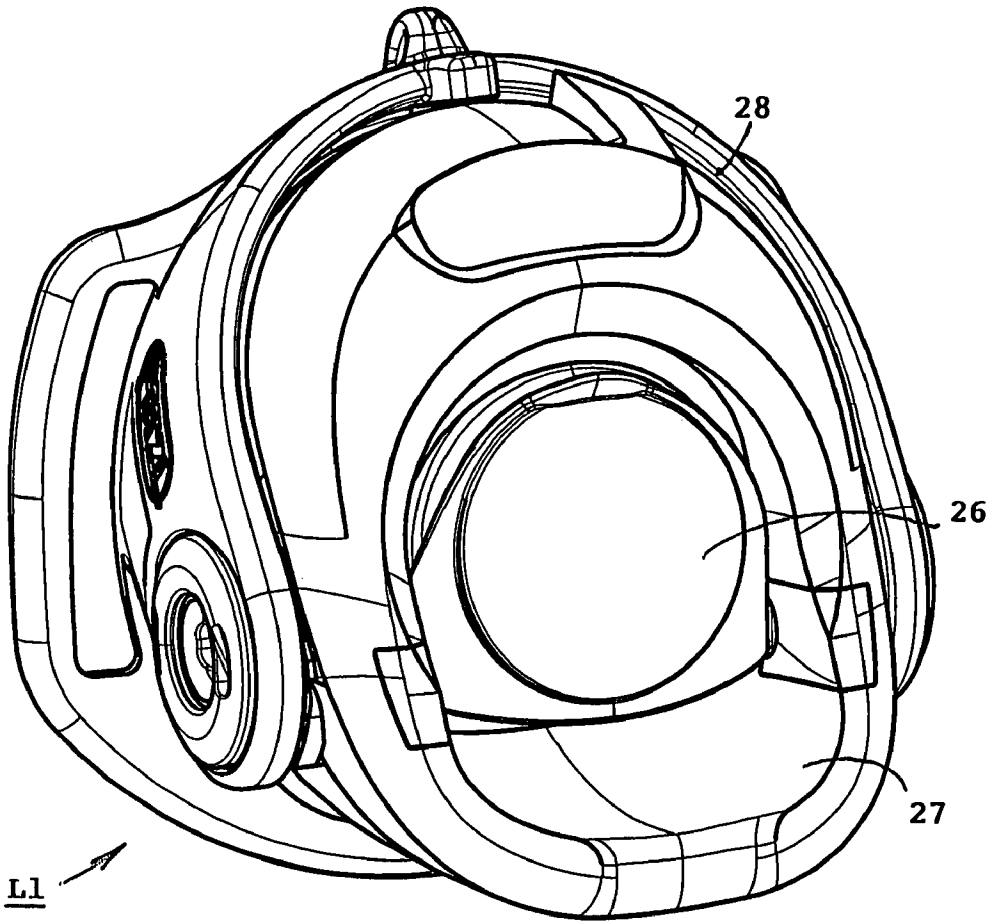
FIGS. 12 and 13 show perspective views of a lighting lamp equipped with an optical focussing device with a swivelling plate, respectively in the active position and the inactive position.
Figure 13:
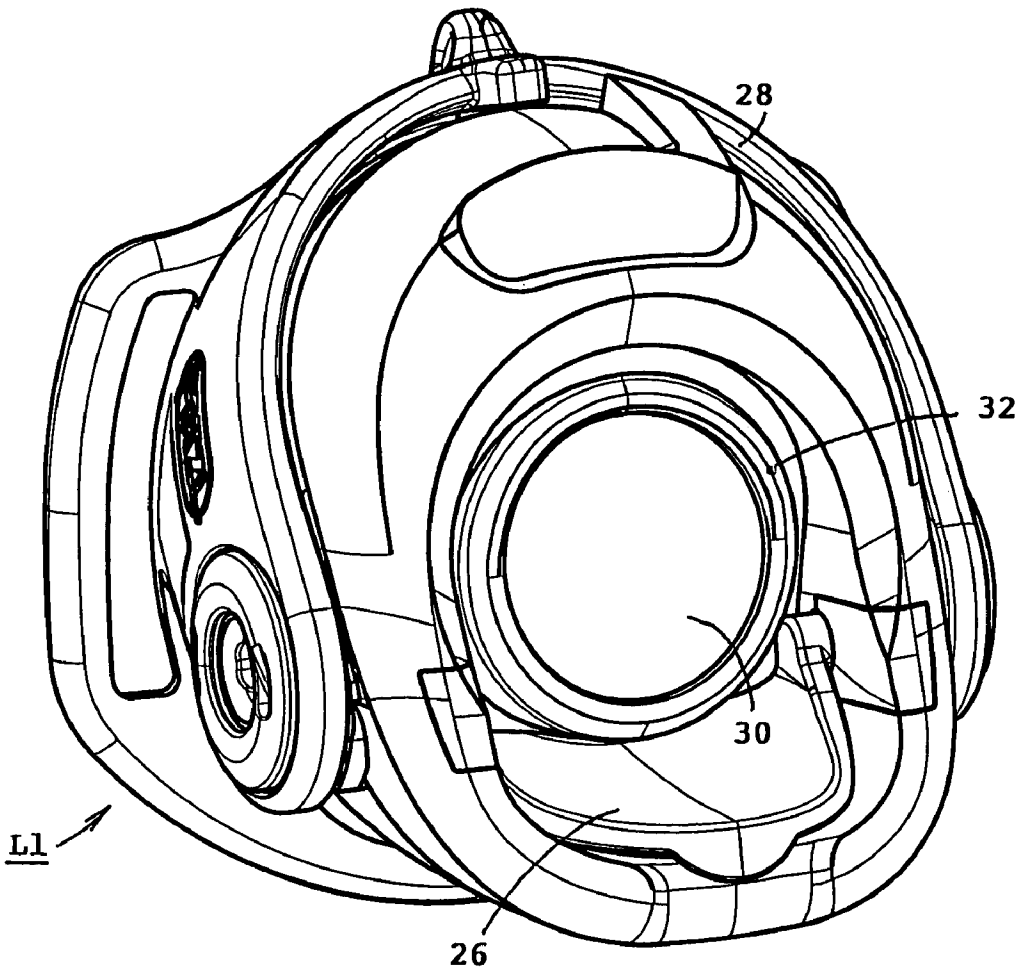
Figure 14:
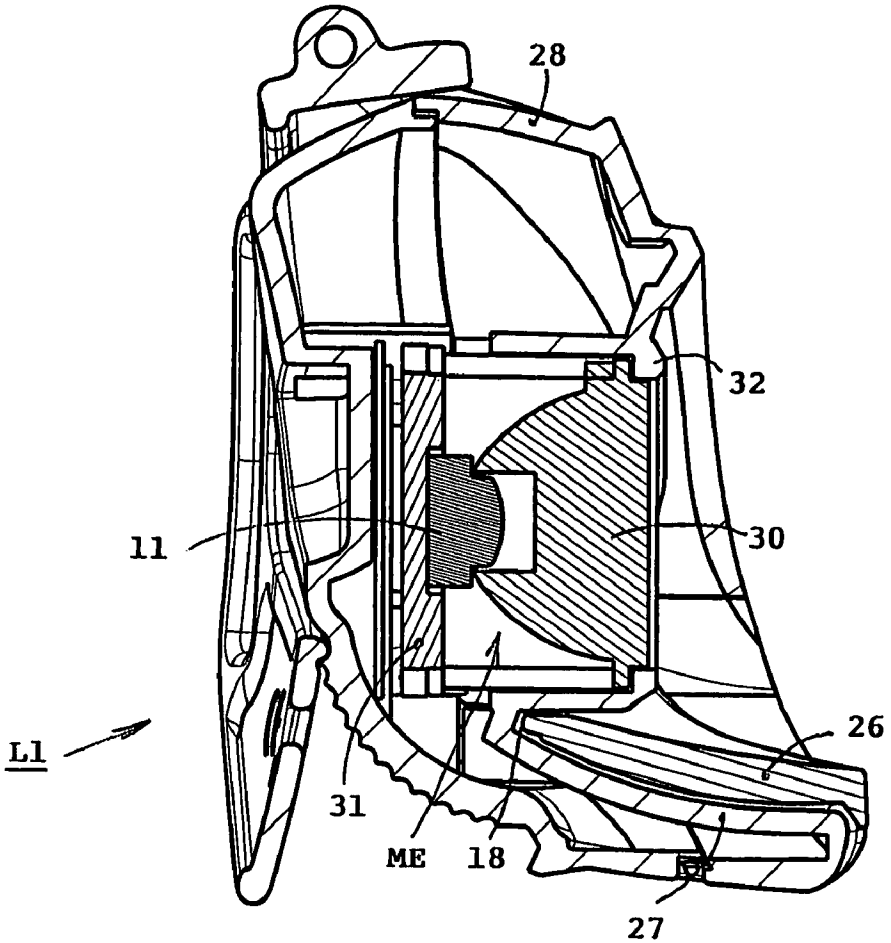
FIG. 14 is a vertical sectional view of FIG. 13.
Figure 15:
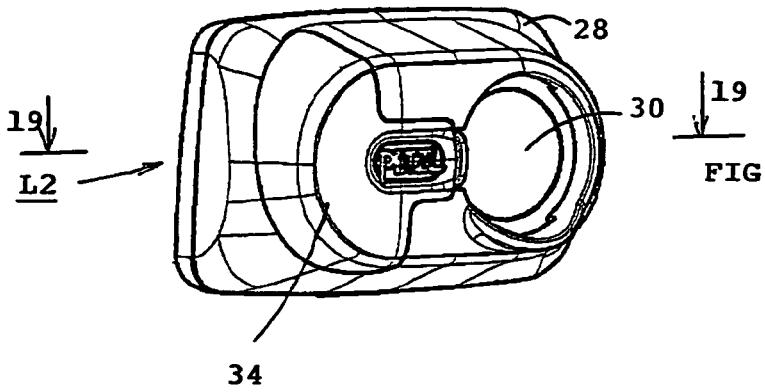
FIGS. 15 to 17 represent an alternative embodiment of the lamp with an optical focussing device sliding in a vertical plane, and illustrated respectively in the inactive position before and after removal of a protective cap, and in the active position.
Figure 16:
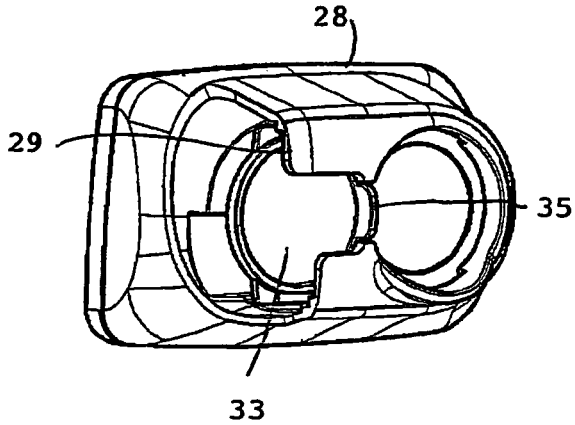
Figure 17:
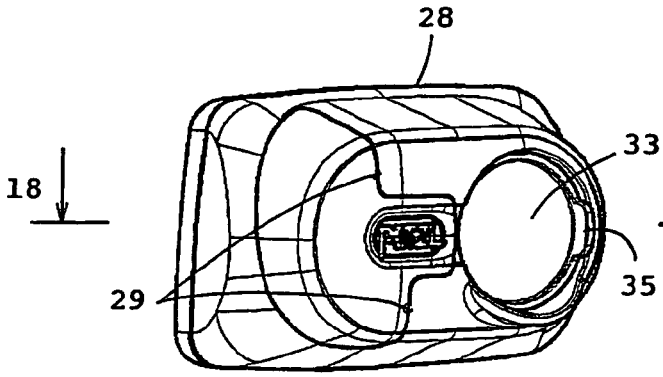
Figure 19:
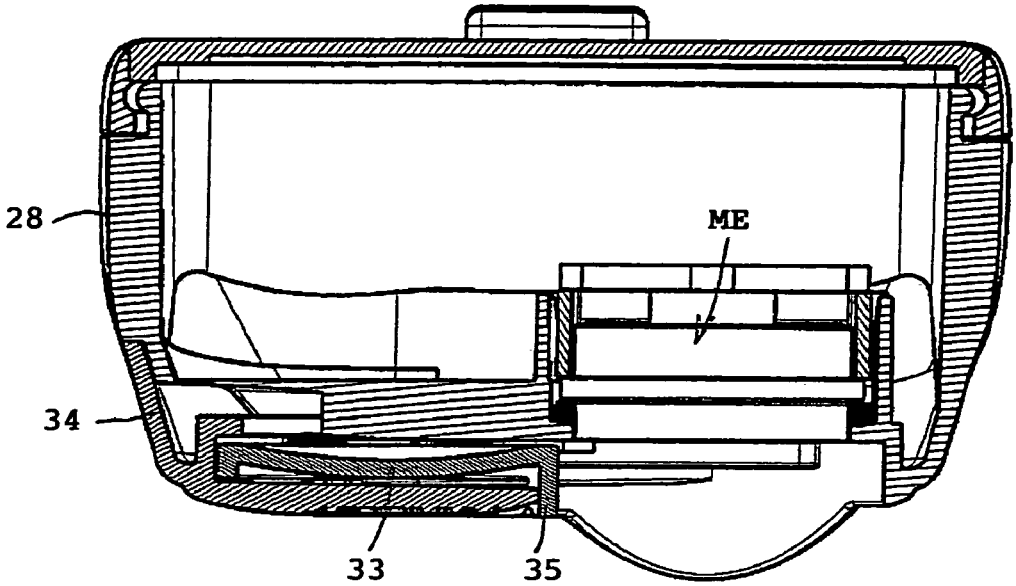
FIGS. 18 and 19 are cross-sectional views of the lamp along the lines 18-18 and 19-19 of FIGS. 17 and 15.
Figure 18:
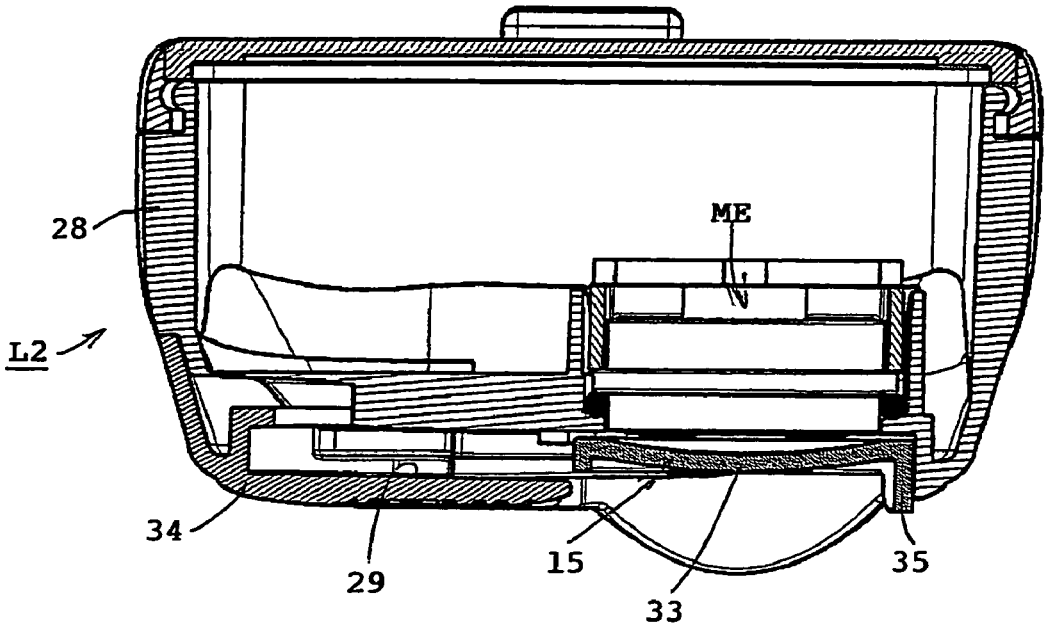

With reference to FIGS. 12 to 14, a lamp L1 is equipped with an emitting module ME with a single diode 11 fitted at the rear on a heat sink 31 and associated at the front with a magnifying glass 30. A semiconductor-based emitting module ME of this kind is a standard off-the-shelf component housed inside the casing 28 and designed to emit a light beam through a circular aperture 32 of the casing. A plate 26 bears the optical focussing device 15, which can be achieved by means of integrated optics, for example made from polycarbonate or glass. The plate 26 is mounted swivelling around a horizontal spindle situated under the emitting module ME. In the active position (FIG. 12), the plate 26 is placed in front of the magnifying glass 30 and the light beam emitted by the diode 11 passes therethrough. In the inactive position (FIGS. 13 and 14), the plate 26 is folded down bearing on a fixed rim 27 of the casing 28 to be protected.

According to the alternative embodiment according to FIGS. 15 to 19, a lamp L2 comprises a casing 28 of rectangular shape having a compartment for housing the emitting module ME and a sliding rack 33 integrating the optical focussing device 15. The rack 33 is movable in translation in a vertical plane perpendicular to the light beam by means of guide grooves 29 provided in the casing 28. The rack 33 is protected by a removable cap 34 able to be slotted into the casing 28. A gripping pin 35 enables the rack 33 to be moved between the withdrawn position (FIG. 19) and the apparent position (FIG. 18) The cap 34 can remain in place during this adjustment operation.

The rack 33 forms a monoblock part having a preset focal distance. This part is easily interchangeable after the cap 34 has been removed.

What is claimed is:

1. A portable lighting lamp, comprising:

a casing;

an emitting module equipped with a light-emitting diode for emitting a light beam;

a fixing and connecting element of said diode; and means for adjusting the light beam comprising one optical focusing device formed by at least one lens arranged on a transparent movable support to form a monoblock part, the support of the optical focusing device being movable manually between an inactive position situated outside a light emission field of the diode and an active position facing the diode to make the visualization angle of the light beam vary between broad lighting with a short range or narrow lighting with a long range, wherein the light-emitting diode is connected at the rear of the casing on a heat sink and associated at the front with a magnifying glass, which is located in an aperture of the casing, and wherein the movable support of the lens is formed by a swiveling plate pivotally mounted around a spindle located under the magnifying glass, and outside the casing, the plate bearing on a fixed rim of the casing in the inactive position, and being placed in front of the magnifying glass in the active position.

* * * * *